US007524250B2

(12) United States Patent
Soracco et al.

(10) Patent No.: US 7,524,250 B2
(45) Date of Patent: Apr. 28, 2009

(54) GOLF CLUB HEAD WITH TOP LINE INSERT

(75) Inventors: Peter L. Soracco, Carlsbad, CA (US); Ryan L. Roach, Carlsbad, CA (US); Christopher B. Best, Encinitas, CA (US)

(73) Assignee: Acushnet Company, Fairhaven, MA (US)

( * ) Notice: Subject to any disclaimer, the term of this patent is extended or adjusted under 35 U.S.C. 154(b) by 328 days.

(21) Appl. No.: 11/266,172

(22) Filed: Nov. 4, 2005

(65) Prior Publication Data

US 2006/0052183 A1 Mar. 9, 2006

Related U.S. Application Data

(63) Continuation-in-part of application No. 10/843,622, filed on May 12, 2004.

(51) Int. Cl.
*A63B 53/00* (2006.01)

(52) U.S. Cl. ..... 473/349

(58) Field of Classification Search ..... 473/290, 473/291, 324, 334, 335, 349, 325
See application file for complete search history.

(56) References Cited

U.S. PATENT DOCUMENTS

| | | | | |
|---|---|---|---|---|
| 1,319,233 | A | 10/1919 | Mattern | 473/337 |
| 2,429,351 | A | 10/1947 | Fetterolf | 473/329 |
| 3,084,940 | A | 4/1963 | Cissel | 473/332 |
| 3,970,236 | A | 7/1976 | Rogers | 228/196 |
| 4,027,885 | A | 6/1977 | Rogers | 473/342 |
| 4,398,965 | A | 8/1983 | Campau | 148/522 |
| 4,523,759 | A | 6/1985 | Igarashi | 473/346 |
| 4,607,846 | A | 8/1986 | Perkins | 473/336 |
| D321,920 | S | 11/1991 | Parente et al. | D21/748 |
| 5,221,087 | A | 6/1993 | Fenton et al. | 473/342 |
| D339,183 | S | 9/1993 | Stites, III | D21/748 |
| D343,216 | S | 1/1994 | Chorne | D21/748 |
| 5,377,979 | A | 1/1995 | Long | 473/310 |
| 5,492,327 | A | 2/1996 | Biafore | 473/332 |

(Continued)

FOREIGN PATENT DOCUMENTS

| | | |
|---|---|---|
| JP | 04-082576 | 3/1992 |

(Continued)

*Primary Examiner*—Raeann Trimiew
(74) *Attorney, Agent, or Firm*—Hanify & King, P.C.

(57) ABSTRACT

A golf club head having a recess located in a top portion thereof is described and claimed. The recess is located between the heel and the toe and extends toward the sole. The recess may be in the top line of the club head. An insert may be placed within the recess. The insert has a density that is less than the density of the club head body, and the insert preferably is a light-weight insert. The insert may include one or more dampening materials. The recess removes material from the club head, which in turn may do one or more of the following: increase the overall size of the club head, expand the size of the club head sweet spot, lower the club head center of gravity, and/or produce a greater club head moment of inertia. Thus, the recess and insert produce a more forgiving and playable golf club. As an alternative to a recess, a thin protrusion may be provided at the top line of the club head and the insert provided with a corresponding groove to facilitate attachment.

21 Claims, 7 Drawing Sheets

U.S. PATENT DOCUMENTS

| | | | | |
|---|---|---|---|---|
| 5,616,088 | A | 4/1997 | Aizawa et al. | 473/341 |
| 5,669,826 | A * | 9/1997 | Chang et al. | 473/332 |
| 5,772,527 | A | 6/1998 | Liu | 473/324 |
| 6,042,486 | A | 3/2000 | Gallagher | 473/329 |
| 6,080,069 | A | 6/2000 | Long | 473/332 |
| RE36,950 | E | 11/2000 | Allen | 473/314 |
| 6,443,857 | B1 | 9/2002 | Chuang | 473/332 |
| 6,592,469 | B2 | 7/2003 | Gilbert | 473/350 |
| 6,773,361 | B1 | 8/2004 | Lee | 473/335 |
| 6,902,495 | B2 | 6/2005 | Pergande et al. | 473/332 |
| 6,921,344 | B2 | 7/2005 | Gilbert et al. | 473/334 |
| 7,048,648 | B2 * | 5/2006 | Breier et al. | 473/340 |
| 2003/0045372 | A1 | 3/2003 | Vrska | 473/332 |
| 2003/0092502 | A1 | 5/2003 | Pergande et al. | 473/332 |
| 2003/0125129 | A1 | 7/2003 | Saksun | 473/341 |
| 2005/0277484 | A1 * | 12/2005 | Reed et al. | 473/332 |

FOREIGN PATENT DOCUMENTS

| | | | |
|---|---|---|---|
| JP | 07-031697 | A | 2/1995 |
| JP | 07-213656 | | 8/1995 |
| JP | 08-057088 | | 3/1996 |
| JP | 3032837 | | 10/1996 |
| JP | 09-173513 | A | 7/1997 |
| JP | 09-225075 | A | 9/1997 |
| JP | 2000-153008 | | 6/2000 |
| WO | WO 2005-082062 | | 9/2005 |

* cited by examiner

GOLF CLUB HEAD WITH TOP LINE INSERT

CROSS-REFERENCE TO RELATED APPLICATIONS

This is a continuation-in-part of U.S. patent application Ser. No. 10/843,622 filed on May 12, 2004, now pending, which is incorporated herein by reference in its their entirety.

BACKGROUND OF THE INVENTION

1. Field of the Invention

The present invention relates to a golf club, and, more particularly, to a golf club head having a top line recess with a light-weight insert.

2. Description of the Related Art

Golf club heads come in many different forms and makes, such as wood- or metal-type, iron-type (including wedge-type club heads), utility- or specialty-type, and putter-type. Each of these styles has a prescribed function and make-up. The present invention relates to golf club heads that have a predominantly solid material area located near the top of the club head.

Iron-type and utility-type golf club heads generally include a front or striking face, a top line, and a sole. The front face interfaces with and strikes the golf ball. A plurality of grooves, sometimes referred to as "score lines," is provided on the face to assist in imparting spin to the ball. The top line is generally configured to have a particular look to the golfer and to provide structural rigidity for the striking face. A portion of the face may have an area with a different type of surface treatment that extends fractionally beyond the score line extents. Some club heads have the surface treatment wrap onto the top line. The sole of the golf club is particularly important to the golf shot because it contacts and interacts with the ground during the swing.

In conventional sets of iron-type golf clubs, each club includes a shaft with a club head attached to one end and a grip attached to the other end. The club head includes a face for striking a golf ball. The angle between the face and a vertical plane is called the loft angle.

The set generally includes irons that are designated number 3 through number 9, and a pitching wedge. One or more additional long irons, such as those designated number 1 or number 2, and wedges, such as a lob wedge, a gap wedge, and a sand wedge, may optionally be included with the set. Each iron has a shaft length that usually decreases through the set as the loft for each club head increases from the long irons to the short irons. The overall weight of each club head increases through the set as the shaft length decreases from the long irons to the short irons. To properly ensure that each club has a similar feel or balance during a golf swing, a measurement known as "swingweight" is often used as a criterion to define the club head weight and the shaft length. Since each of the clubs within the set is typically designed to have the same swingweight value for each different lofted club head or given shaft length, the weight of the club head is confined to a particular range.

The length of the shaft, along with the club head loft, moment of inertia, and center of gravity location, impart various performance characteristics to the ball's launch conditions upon impact and dictate the golf ball's launch angle, spin rate, flight trajectory, and the distance the ball will travel. Flight distance generally increases with a decrease in loft angle. However, difficulty of use also increases with a decrease in loft angle.

Iron-type golf clubs generally can be divided into three categories: blades and muscle backs, conventional cavity backs, and modern multi-material cavity backs. Blades are traditional clubs with a substantially uniform appearance from the sole to the top line, although there may be some tapering from sole to top line. Similarly, muscle backs are substantially uniform, but have extra material on the back thereof in the form of a rib that can be used to lower the club head center of gravity. A club head with a lower center of gravity than the ball center of gravity facilitates getting the golf ball airborne. Since blade and muscle back designs have a small sweet spot, which is a term that refers to the area of the face that results in a desirable golf shot upon striking a golf ball, these designs are relatively difficult to wield and are typically only used by skilled golfers. However, these designs allow the skilled golfer to work the ball and shape the golf shot as desired.

Cavity backs are modern designs that move some of the club mass to the perimeter of the club by providing a hollow or cavity in the back of the club, opposite the striking face. This produces a more forgiving club with a larger sweet spot. Having a larger sweet spot increases the ease of use. The decrease in club head mass resulting from the cavity also allows the size of the club face to be increased, further enlarging the sweet spot. The perimeter weighting created by the cavity also increases the club's moment of inertia, which is a measurement of the club's resistance to torque, for example the torque resulting from an off-center hit. These clubs are easier to hit than blades and muscle backs, and are therefore usable by less-skilled and beginner golfers.

Modern multi-material cavity backs are the latest attempt by golf club designers to make cavity backs more forgiving and easier to hit. Some of these designs replace certain areas of the club head, such as the striking face or sole, with a second material that can be either heavier or lighter than the first material. These designs can also contain deep undercuts, which stem from the rear cavity, or secondary cavities. By incorporating materials of varying densities or providing cavities and undercuts, mass can be freed up to increase the overall size of the club head, expand the sweet spot, enhance the moment of inertia, and/or optimize the club head center of gravity location. However, due to construction limitations or requirements, some of these designs inadvertently thicken the top portion of the club head. Still, these improvements make the multi-material cavity back design the easiest of all styles to hit, and are ideally suited for the less adroit or novice golfer.

As mentioned above, producing a low center of gravity in a club head increases its playability. One of the ways to lower the center of gravity is to lower the face profile of the head. However, this produces a club head with a bad aesthetic appearance. Another method of reducing the club's center of gravity is to reduce the height of the hosel. However, there are disadvantages to reducing the hosel height, such as: reduced moment of inertia (since hosel mass is far away from the center of gravity), shaft-bonding concerns, and the inability to customize the club head via bending for loft/lie. In addition, many golfers dislike the appearance of a club head that has a very small hosel.

SUMMARY OF THE INVENTION

The present invention relates to a golf club head having a body defining a front surface, a top line, a sole, a back, a heel, a toe, and a hosel. The top portion of the club head, preferably the top line, contains a recess therein located between the heel and the toe, and extending toward the sole. This recess removes material from the club head, allowing the opportunity to do one or more of the following: increase the size of the overall club head, expand the size of the club head sweet spot, lower the club head center of gravity, and/or produce a greater moment of inertia measured about a vertical or horizontal axis passing through the club head center of gravity. The golf club head of the present invention preferably is an iron-type, a utility-type, or a putter-type golf club head.

An insert formed of a secondary material may be placed within the recess. The insert has a density that is less than the density of the club head body, and the insert preferably is a light-weight insert. This allows the mass removed by the recess to be replaced in more desirous locations on the club head, such as in the perimeter and/or toward the sole. The insert may contain one or more dampening materials, such as a viscoelastic material, which have the added benefit of dissipating vibrations that may be created during the golf shot. The incorporation of this secondary material provides improved feel and improved weight distribution, enhancing performance of the club, while still maintaining an aesthetically pleasing overall head shape. The incorporation of this secondary material also improves wearing of the heads over time since the viscoelastic material covers the top-toe area of the club, which is primarily responsible for marks on the head due to club-to-club impacts as the clubs rest in a player's bag.

Instead of a recess, an extension may be provided at the top portion of the club head where relatively high density metallic material has been removed. The insert is attached to the extension.

DESCRIPTION OF THE DRAWING

The present invention is described with reference to the accompanying drawings, in which like reference characters reference like elements, and wherein.

DETAILED DESCRIPTION OF THE INVENTION

Other than in the operating examples, or unless otherwise expressly specified, all of the numerical ranges, amounts, values, and percentages, such as those for amounts of materials, moments of inertias, center of gravity locations, and others in the following portion of the specification, may be read as if prefaced by the word "about" even though the term "about" may not expressly appear with the value, amount, or range. Accordingly, unless indicated to the contrary, the numerical parameters set forth in the following description and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in any specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Figure 1:
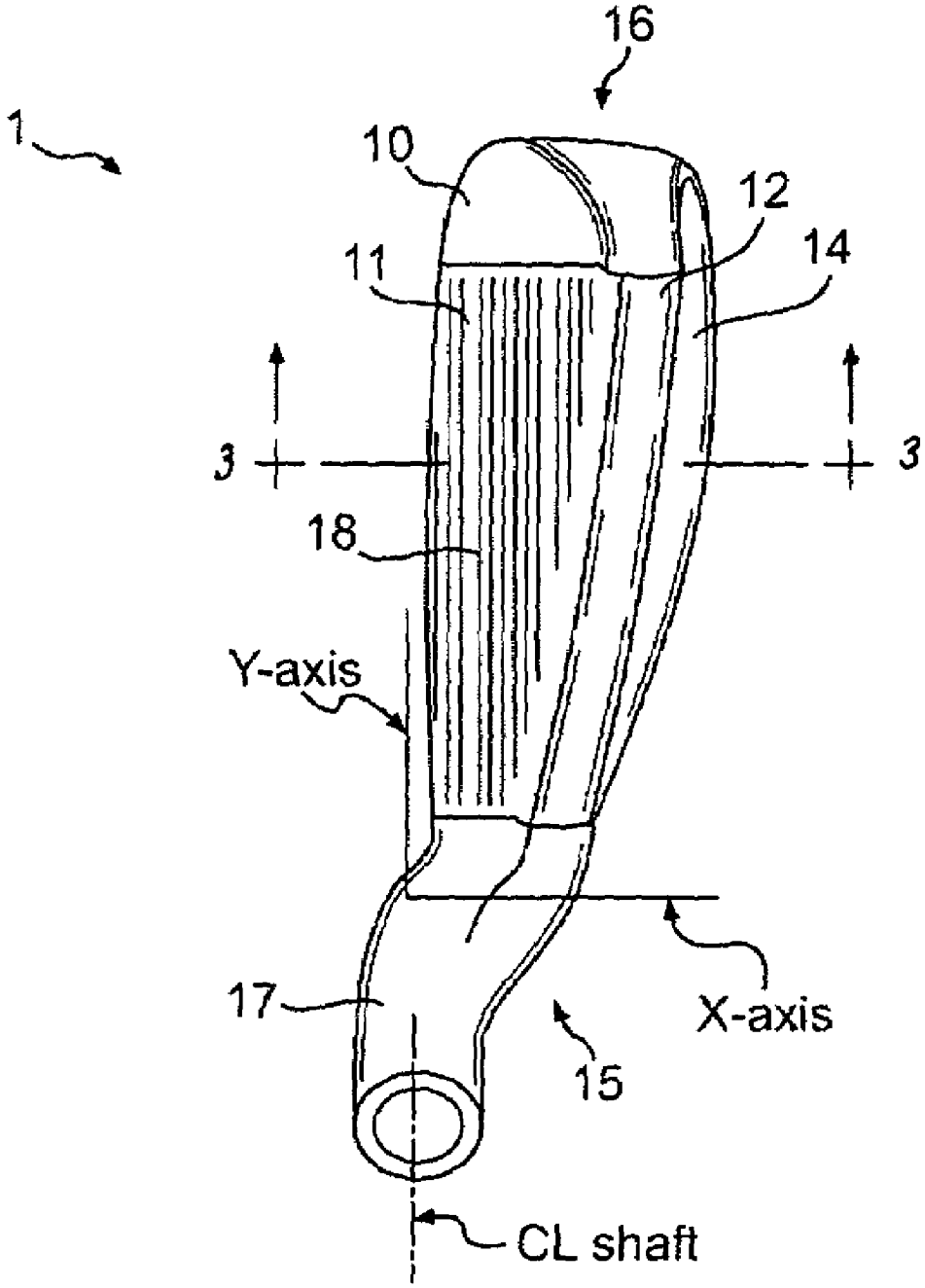
FIG. 1 is a top view of a golf club head of the present invention.
Figure 2:
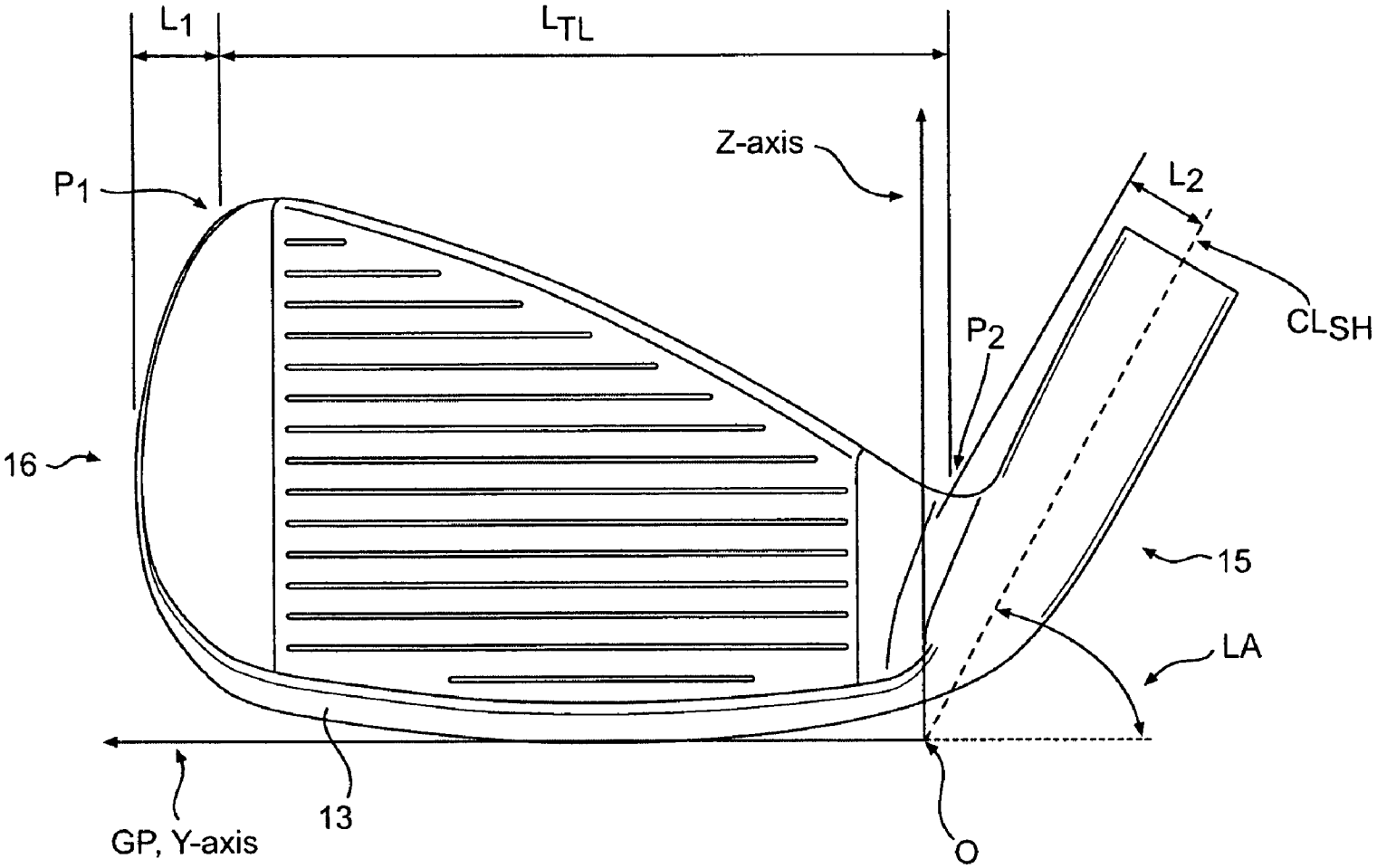
FIG. 2 is a front view of the golf club head of FIG. 1.

FIG. 1 is a top view of a golf club head 1 of the present invention, and FIG. 2 is a front view of the golf club head 1. The golf club head 1 includes a body 10 defining a front surface 11, a top line 12, a sole 13, a back 14, a heel 15, a toe 16, and a hosel 17. The striking face of the front surface 11, which preferably contains grooves 18 therein, and the sole 13 may be unitary with the body 10, or they may be separate bodies, such as inserts, coupled thereto. While the club head 1 is illustrated as an iron-type golf club head, the present invention may also pertain to a utility-type golf club head or a putter-type club head.

FIGS. 1 and 2 define a convenient coordinate system to assist in understanding the orientation of the golf club head 1 and other terms discussed herein. An origin O is located at the intersection of the shaft centerline $CL_{SH}$ and the ground plane GP, which is defined at a predetermined angle from the shaft centerline $CL_{SH}$, referred to as the lie angle LA, and tangent to the sole 13 at its lowest point. An X-axis is defined as a vector that is opposite in direction of the vector that is normal to the face 11 projected onto the ground plane GP. A Y-axis is defined as the vector perpendicular to the X-axis and directed toward the toe 16. A Z-axis is defined as the cross product of the X-axis and the Y-axis.

The top portion of the club head 1 contains a recess 20 therein, located between the heel 15 and the toe 16 and extending toward the sole 13. Preferably, the recess 20 is located in the top line 12 of the club head 1 and extends along the top line 12 from approximately 10% to approximately 95% of the top line length. The top line length $L_{TL}$ is defined as the distance along the top line 12 from a point $P_1$ to a point $P_2$. Point $P_1$ is defined as the intersection of the golf club head 1 and a plane that is offset 0.2 inch ($L_1$) from and parallel to a plane defined by the X-axis and the Z-axis tangent to the toe 16 at the toe's furthest point from the origin O along the Y-axis. Point $P_2$ is defined as the uppermost intersection of the club head 1 and a plane that is parallel to the plane formed by the shaft centerline $CL_{SH}$ and the X-axis offset a distance of 0.3 inch ($L_2$) in a direction closer to the toe 16. The recess 20 removes material from the club head 1, which can be redistributed to other areas of the club head 1 to do one or more of the following: increase the overall size of the club head 1, expand the size of the club head sweet spot, reposition the club head center of gravity, and/or produce a greater moment of inertia (MOI) measured about either an axis parallel to the Y-axis or Z-axis passing through the club head center of gravity. Inertia is a property of matter by which a body remains at rest or in uniform motion unless acted upon by some external force. MOI is a measure of the resistance of a body to angular acceleration about a given axis, and is equal to the sum of the products of each element of mass in the body and the square of the element's distance from the axis. Thus, as the distance from the axis increases, the MOI increases, making the club more forgiving for off-center hits since less energy is lost during impact from club head twisting. Moving or rearranging mass to the club head perimeter enlarges the sweet spot and produces a more forgiving club. Moving as much mass as possible to the extreme outermost areas of the club head 1, such as the heel 15, the toe 16, or the sole 13, maximizes the opportunity to enlarge the sweet spot or produce a greater MOI. The recess 20 preferably has a volume of approximately 0.001 $in^3$ to approximately 0.2 $in^3$. In relative terms, the recess 20 preferably has a volume that is from approximately 0.5% to approximately 10% of the volume of the body 10. The recess 20 preferably has a depth D from approximately 0.01 inch to approximately 0.25 inch, which may be a constant depth or a varying depth.

Figure 4:
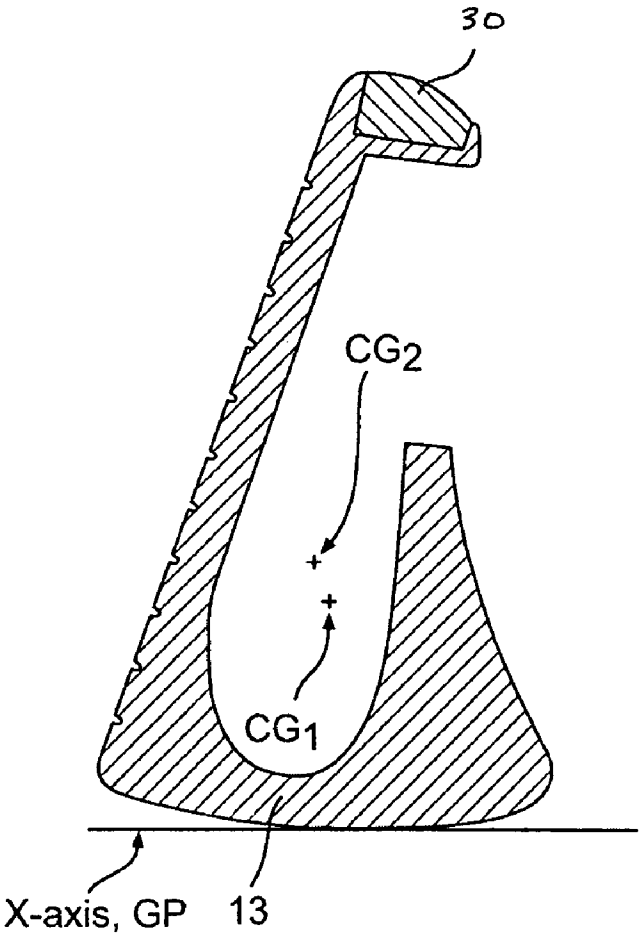
FIG. 4 is a cross-sectional view of the golf club head of FIG. 1, including an insert, taken along lines 3-3.
Figure 3:
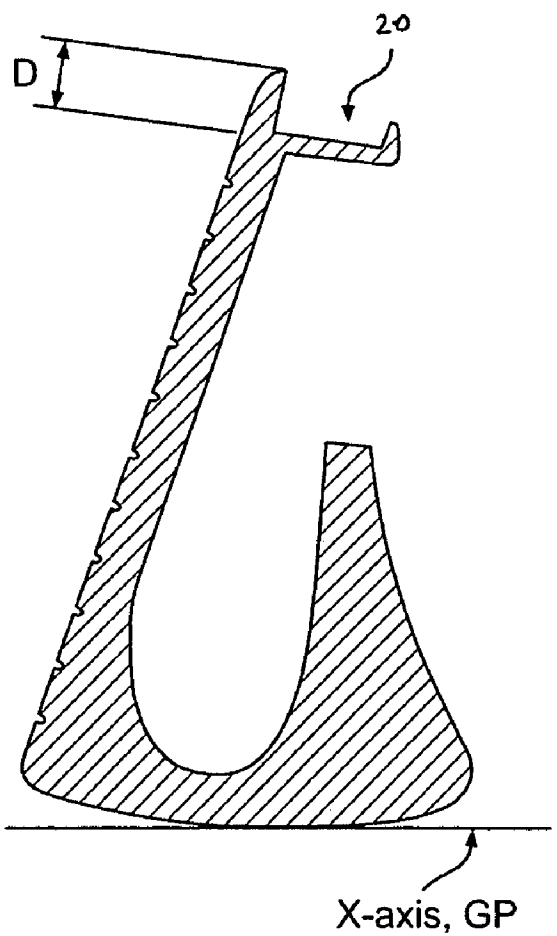
FIG. 3 is a cross-sectional view of the golf club head of FIG. 1 taken along lines 3-3.
Figure 5:
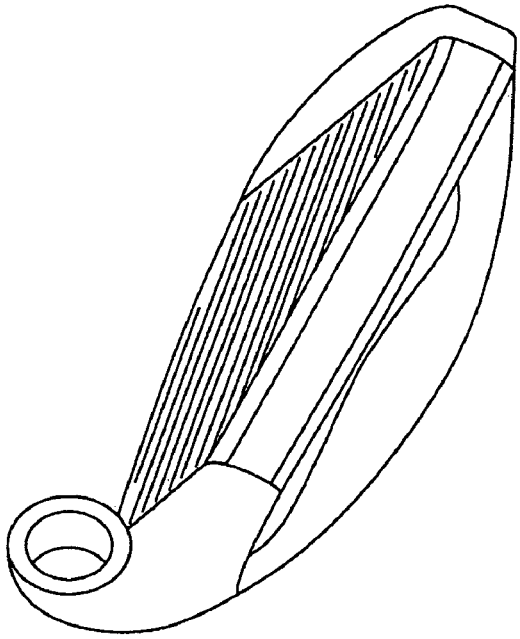
FIG. 5 shows a first isometric view of the golf club head of FIG. 1.
Figure 6:
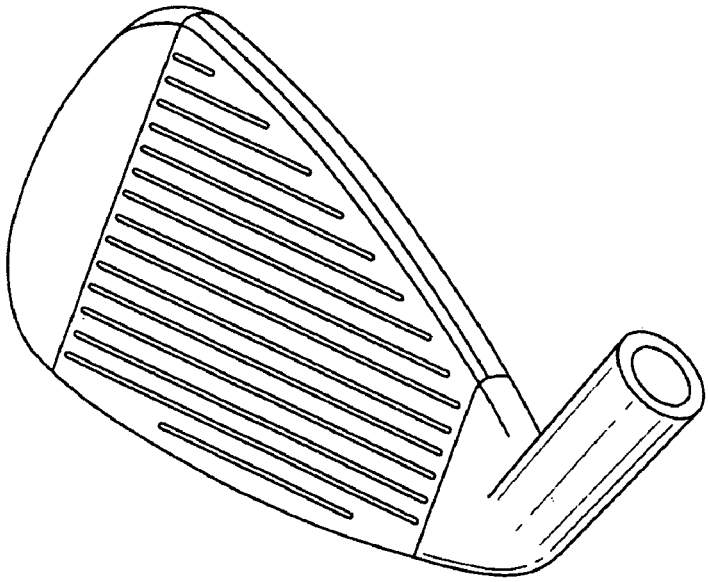
FIG. 6 shows a second isometric view of the golf club head of FIG. 1.

An insert 30 may be positioned within the recess 20. The insert 30, which may be either a preformed insert or cast in place within the recess 20, may be configured to matingly correspond to the recess 20. That is, the insert 30 may be formed and configured to match the contours of the recess 20 and to substantially fill the recess 20. Alternatively, the insert 30 fills only a portion of the recess 20. The insert 30 has a density that is less than the density of the club head body 10. Since the mass of the insert 30 is less than the mass removed by the recess 20, the extra mass may be replaced in more desirous locations on the club head 1. These locations may include, for example, the club head perimeter and/or the sole 13. Alternatively, no additional mass is added to the club head 1; only the recess 20 and the insert 30 are used to enhance the playing characteristics of the golf club. The insert 30 preferably has a density from approximately 0.5 $g/cm^3$ to approximately 5 $g/cm^3$, and is preferably less than the body density by at least 3 $g/cm^3$. The net effect of creating the recess 20 and adding the insert 30 lowers the club head center of gravity ($CG_1$ in FIG. 4) at least 0.01 inch toward the sole 13, as compared to the center of gravity location of a club head without the recess 20 and the insert 30 ($CG_2$ in FIG. 4). That is, the golf club head 1 has a center of gravity located at least 0.01 inch from a center of gravity location for a substantially similar golf club head without the recess 20 and the insert 30. More preferably, the club head center of gravity is lowered at least 0.025 inch toward the sole 13. Additionally, the recess 20 and the insert 30 increase the club head MOI measured about an axis parallel to the Z-axis and passing through the center of gravity by at least 20 $gm \cdot in^2$. That is, the club head 1 has an increase in MOI measured about a vertical axis passing through said center of gravity of at least 20 $gm \cdot in^2$ compared to a substantially similar golf club head without the recess 20 and the insert 30. Thus, the recess 20 and insert 30 produce a more forgiving and playable golf club. FIGS. 5 and 6 show isometric views of the golf club head 1.

The insert 30 may contain one or more dampening materials, which diminish vibrations in the club head, including vibrations generated during an off-center hit. Preferred dampening materials include those materials known as thermoplastic or thermoset polymers, such as rubber, urethane, polyurethane, butadiene, polybutadiene, silicone, and combinations thereof. Energy is transferred from the club to the ball during impact. Some energy, however, is lost due to vibration of the head caused by the impact. These vibrations produce undesirable sensations in both feel and sound to the user. Because the viscoelastic dampening material of the insert 30 is in direct contact with the metal club head (the vibrating body), it serves to dampen these vibrations, improving sound and feel. Typical hardness values for the insert 30 may include from 80 Shore A to 50 Shore D. Typical densities for the insert 30 may include from 1.2-2 $g/cm^3$.

Figure 7:
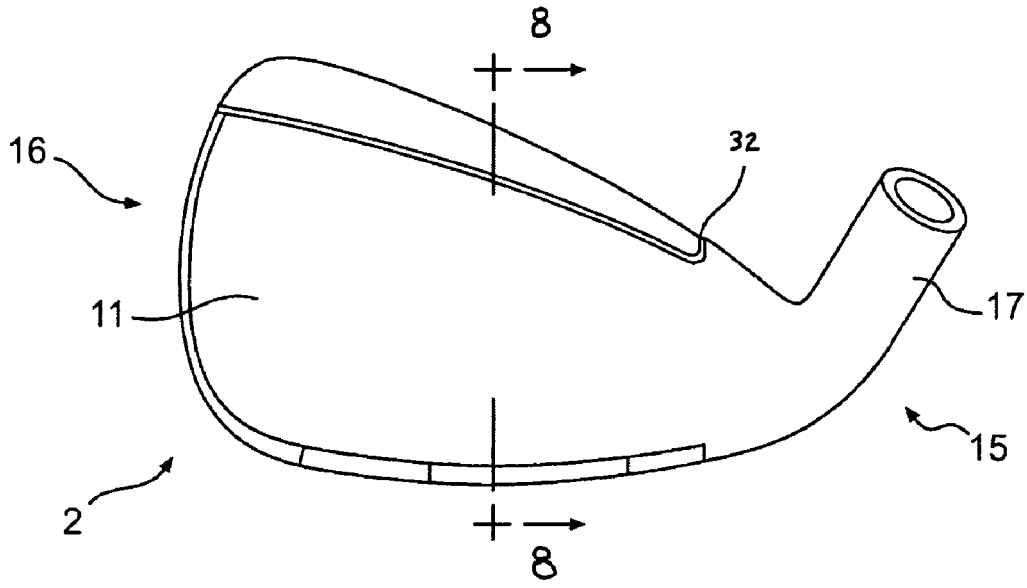
FIG. 7 shows another golf club head of the present invention.
Figure 8:
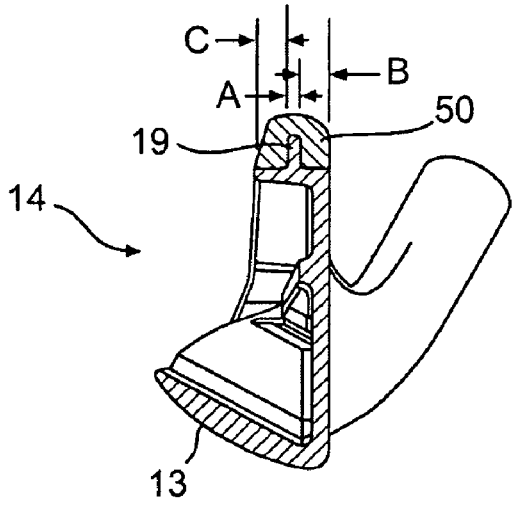
FIG. 8 shows a cross-sectional view of the golf club head of FIG. 7 taken along line 8-8.

FIG. 7 shows another exemplary golf club head 2 of the present invention, and FIG. 8 shows a cross-sectional view of the golf club head 2 taken along line 8-8. In this embodiment, material is removed from the metallic club head at the top line 12. Instead of forming a recess at the top line 12, however, a thin protrusion 19 is provided. Metallic material has been removed from the top portion of the club head as described above, and a thin extension 19 is left in place. The insert 30 has a groove corresponding to the protrusion 19. Thus, the viscoelastic material can be fit onto the club head body 10. The insert 30 is attached to the casting, for example, through the use of an epoxy. A fixture with a cavity that matches the outer perimeter shape of the club head 1 should be used to hold the two pieces in place while the epoxy dries. A preferred width A for the protrusion 19 is 0.06 in., though wider protrusions 19 may be used. This width ensures adequate structural integrity. Preferred heights for the protrusion 19 include 0.06 in. to 0.25 in., though other heights may be used.

It is possible that there are variations in size of the metallic portions of the club heads 1, 2 caused during forming and polishing. These variations typically are larger than the variations in size due to molding viscoelastic materials of the inserts 30. To aid in hiding any discrepancy between the two portions of the club head, a groove 32 may be formed in the insert 30 the edges that are visible to the user once the two pieces have been put together. This groove 32 may be created simultaneously with the rest of the insert 30, or as a secondary step. The preferred width and depth of the groove 32 are 1 mm or less.

In the illustrated example of FIGS. 7 and 8, the protrusion 19 is formed in the center of the top line 12. Alternatively, the protrusion 19 can be formed towards or at the front of the top line 12 or towards or at the rear of the top line 12. The width B of the front portion of the insert 30 may be zero, meaning the protrusion 19 forms the top portion of the face 11. Alternatively, the width B may be, for example, 0.03 to 0.25 in. Similar to the width B, the width C of the rear portion of the insert 30 may be zero, meaning the protrusion 19 forms the top portion of the back 14. Alternatively, the width C may be, for example, 0.03 to 0.25 in. The height of the insert 30, measured along the longest portion thereof, preferably may be from 0.03 to 0.3 in.

A body's center of gravity is determined by its weight distribution. Mass added or removed directly on the center of gravity will have no effect on the center of gravity's location. In contrast, mass added or removed far away from the center of gravity will have the greatest effect on moving the center of gravity. Removing mass from the highest areas of a club head will have the greatest effect on lowering the center of gravity. Adding the mass removed from the high areas to the bottom of the club head will further lower the center of gravity. The top line area and top-of-hosel area are the two highest vertical areas in relation to the ground plane on an iron-type head (when the head is at the address position). By removing the top line portion of the face from the casting and replacing it with a lightweight viscoelastic piece, anywhere from 20-50 grams are removed from the top of the head, depending upon the design of the viscoelastic piece. That weight is redistributed to the bottom portion of the club, lowering the center of gravity even further versus that same club head constructed entirely of a metallic material, such as steel.

MOI is also a property that is affected by mass distribution. Bodies that have mass distributed far from the center of gravity have higher MOI's about their center of gravity than bodies that have mass concentrated near their center of gravity. Removing the mass from the top of the face lowers the MOI about the center of gravity with respect to certain axes. The axis of rotation that relates to an iron's forgiveness is rotation in the heel-toe direction about the center of gravity—an axis parallel to the Z-axis. A higher MOI about this axis indicates greater resistance to twisting on off-center hits and, thus, more forgiveness. By adding the mass removed from the top line 12 back into the low-heel and low-toe areas of the club head, the reduction in MOI in the heel-toe direction due to removal of metallic material from the top line 12 is minimized.

Table 1 shows a comparison of center of gravity locations and MOI's for a 6-iron having a urethane insert 30 as shown in FIGS. 7 and 8 to a similar club head formed completely of steel. Note that the measurements presented in Table 1 do not include any weights that may be added to the club head.

TABLE 1

| | 6-iron with Urethane Top Line | 6-iron with Steel Top Line |
|---|---|---|
| Head mass | 23.83 g | 240.2 g |
| Top Line mass | 4.9 g | 31.1 g |
| Total mass | 243.2 g | 271.3 g |
| $CG_x$ | 1.355 in. | 1.397 in. |
| $CG_y$ | 0.766 in. | 0.862 in. |
| $CG_z$ | −0.478 in. | −0.533 in. |
| $I_{xx}$ | 541 $g \cdot cm^2$ | 740 $g \cdot cm^2$ |
| $I_{yy}$ | 2588 $g \cdot cm^2$ | 2764 $g \cdot cm^2$ |
| $I_{zz}$ | 2832 $g \cdot cm^2$ | 3110 $g \cdot cm^2$ |
| k | 1.173 in. | 1.175 in. |

$CG_x$, $CG_y$, and $CG_z$ are the x-, y-, and z-components of the center of gravity location, respectively. $I_{xx}$, $I_{yy}$, and $I_{zz}$ are the MOI's about the x-, y-, and z-axes, respectively. k is the spring constant.

Use of the insert 30 pictured in FIGS. 7 and 8 has the added benefit of increasing the durability of the club head 2. Over the course of play, clubs carried together in a bag are knocked together. These impacts create marks on the club heads. The top-toe portion of the club is an area that is likely to impact with other clubs. By making that area out of a softer material, the likelihood of creating marks on the head due to club-to-club impacts is reduced.

Figure 9:
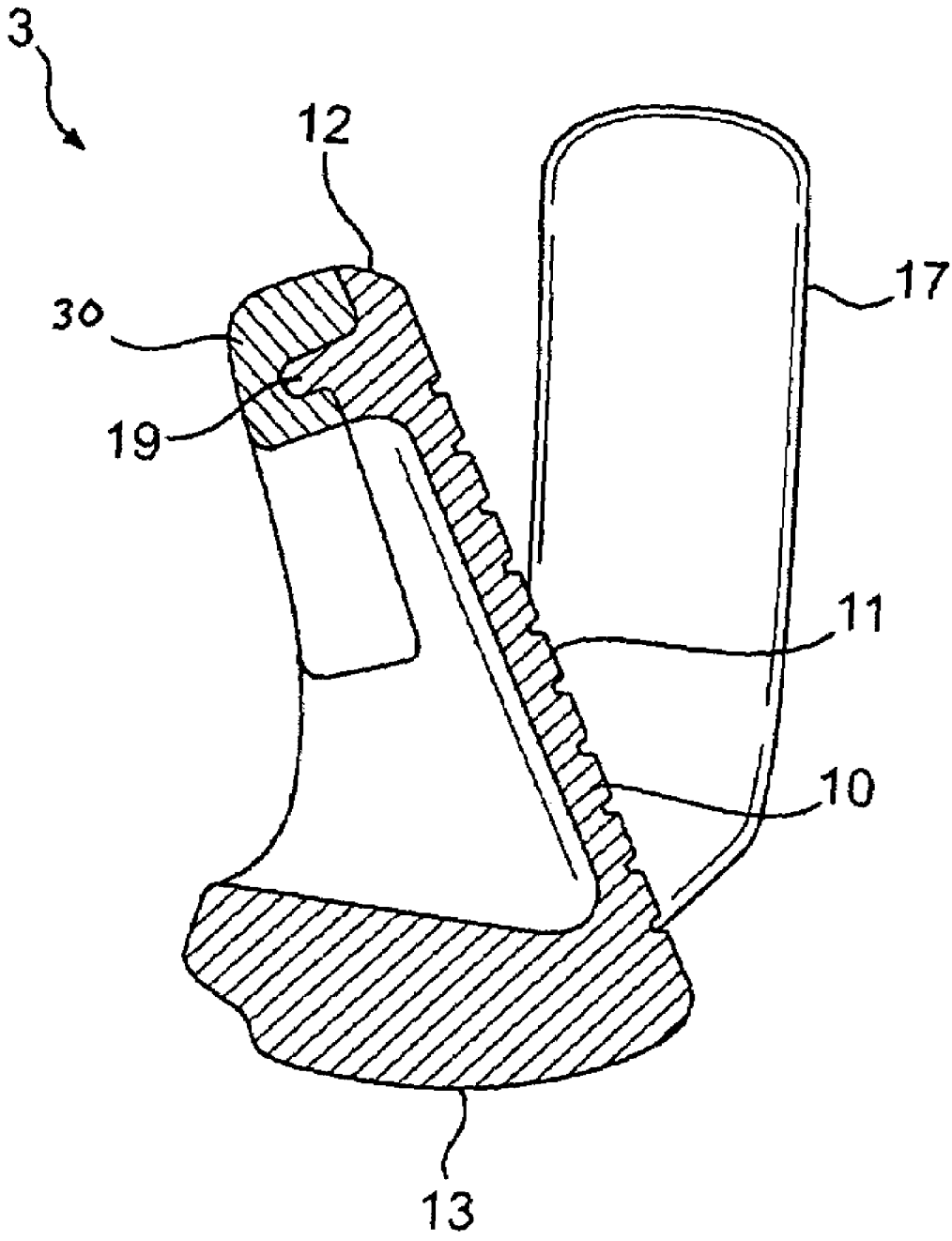
FIG. 9 shows a cross-sectional view of another golf club head of the present invention.

FIG. 9 shows a cross-sectional view of another golf club head 3 of the present invention with the toe portion removed. In this embodiment, metallic material has also been removed from the top line 12 and replaced with a light-weight viscoelastic insert 30. A protrusion 19 is also provided in this club head 3, but unlike the previously discussed club head 2 it is directed backward away from the face 11. The insert 30 contains a groove corresponding to the protrusion 19. Attachment is facilitated through the protrusion 19 and groove. The metallic face material extends to the upper most portion of the face 11 at the top line 12. Alternatively, the viscoelastic material may extend down the top portion of the face 11, for example, up to 0.3 in.

Figure 10:
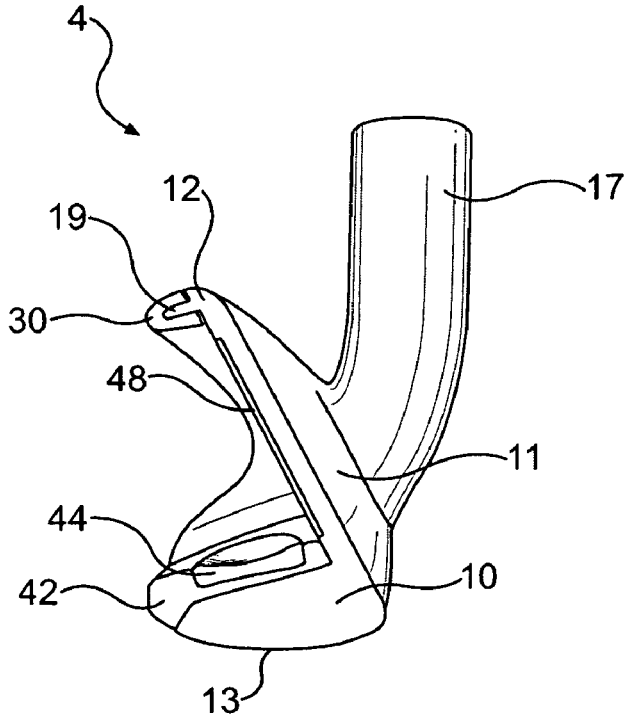
FIG. 10 shows a cross-sectional view of another golf club head of the present invention.
Figure 11:
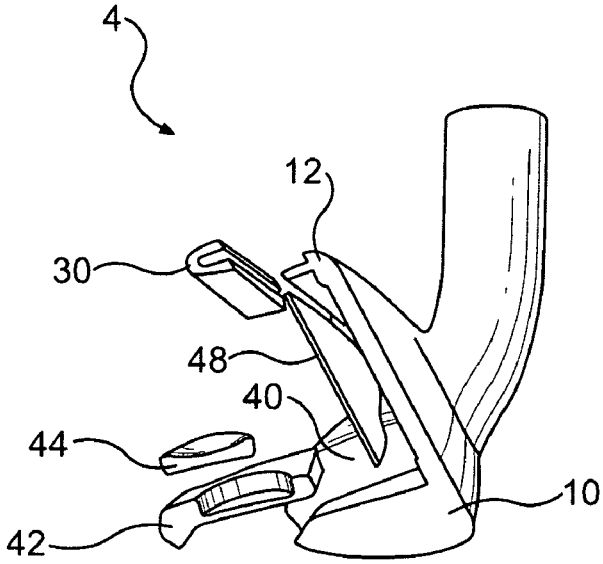
FIG. 11 shows an exploded view of the golf club head of FIG. 10.

FIG. 10 shows a cross-sectional view of another golf club head 4 of the present invention, and FIG. 11 shows an exploded view of the golf club head 4 and its individual components. In this embodiment, metallic material has also been removed from the top line 12 and replaced with an insert 30. Similarly to the previously discussed embodiments, the insert 30 preferably is coupled to the club head 4 via a protrusion 19. In the illustrated embodiment, the protrusion 19 extends rearward from the body 10 near the top 12 of the club head 4, and the entire front surface 11 of the club head 4 is formed of a metallic material. Metallic mass is removed from the rearward side of the top 12 behind the front surface 11. The protrusion 19 can be positioned at any desired location towards the top 12 of the club head 4. The insert 30 is formed of a material, such as nylon, having a high strength-to-weight ratio and a high impact strength-to-weight ratio. These properties ensure that the insert 30 provides a solid feel to the club head 4 while achieving the benefits, discussed above, of removing metallic material from the top line 12. The insert material preferably has the following properties at 50% relative humidity and 73° F.: tensile strength of 15 kpsi to 20 kpsi, 17.5 kpsi being preferred; flexural modulus of 650 kpsi to 750 kpsi, 600 kpsi being preferred; notched impact strength of 3 ft·lb/in to 4 ft·lb/in, 3.5 ft·lb/in being preferred; and specific gravity of 1.25 to 2, 1.4 being preferred. These properties and measurement methods are discussed in ASTM D 638, ASTM D 790, ASTM D 256, and ASTM D 792, respectively, which are incorporated herein by reference. One preferred material for the insert 30 of this embodiment is a 33% glass reinforced nylon 66. Zytel® 74G33L NC 010 from DuPont is a preferred nylon. This product meets the preferred physical properties and allows the club designer to provide a top line 12 with a surface finish similar to that of an all steel club head, which may be beneficial to some golfers. More or less glass reinforcement may be used. 25% to 50% is a preferred range for glass (including fiberglass) reinforcement in the nylon material of the insert 30. Other reinforcing materials other than glass may also be used.

The club head 4 of FIG. 10 further includes a recess 40 in the upper portion of the sole 13 between the heel 15 and the toe 16. By this recess 40, additional metallic material is removed from the central portion of the club head, further biasing mass towards the club head perimeter and allowing mass to be redistributed to more beneficial locations of the club head 4. The recess 40 may extend completely through the sole 13, or only partially into the sole 13. A second insert 42, preferably formed of a viscoelastic material, may be included within the recess 40. This insert 42 provides a filled-in look to the club head 4, and may further reduce or eliminate unwanted vibrations. A medallion 44 or other weight member may be included in the second insert 42. Inclusion of a weight member 44 coupled to the insert 42 opposite the body 10 of the club head 4 creates a constrained-layer damping system to dissipate unwanted vibrations generated during use of the golf club. The insert 42 and weight member 44 are coupled in known fashion, such as through use of an adhesive. Mechanical fasteners may also be used, alone or in conjunction with an adhesive. The insert 42 may include a recess in which the weight member 44 is attached, providing a smooth transition between the insert 42 and the weight member 44.

A third insert 48 may also be included with the club head 4. This third insert 48 preferably is coupled to the back 14 of the club head 4, opposite the front surface 11. The insert 48 preferably is formed of a viscoelastic material, and thus it damps unwanted vibrations via free-layer damping. The insert 48 may be coupled to the club head 4 in any known manner, such as via an adhesive. The insert 48, as well as the other inserts described herein, may also inherently possess adhesive properties such that it may coupled directly to the club head without the need of a separate adhesive material.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention.

Thus the present invention should not be limited by the above-described exemplary embodiments, but should be defined only in accordance with the following claims and their equivalents. Furthermore, while certain advantages of the invention have been described herein, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

What is claimed is:

1. A golf club head, comprising:

a body formed of a first material and having a front surface, a sole, a back, a heel, a toe, and a top, wherein said sole has a top surface defining a recess therein between said heel and said toe;

an insert formed of a second material coupled to said body at said top, said insert formed of a material including nylon; and a second insert positioned within said recess, said second insert formed of a viscoelastic material, wherein said second insert has a surface defining a second recess and further comprises a weight member coupled to said second insert within said second recess.

2. The golf club head of claim 1, further comprising a third insert coupled to said back opposite said front surface, said third insert being formed of a viscoelastic material.

3. The golf club head of claim 1, further comprising a protrusion extending away from the body at the top, and wherein the insert is coupled to the body at the protrusion.

4. The golf club head of claim 1, wherein the club head has a top line formed by portions of the insert and the body.

5. The golf ball of claim 1, wherein the nylon has a tensile strength of 15 kpsi to 20 kpsi at 50 percent relative humidity and 73° F.

6. The golf ball of claim 1, wherein the nylon has a flexural modulus of 650 kpsi to 750 kpsi at 50 percent relative humidity and 73°°F.

7. The golf ball of claim 1, wherein the nylon is a 33 percent glass reinforced nylon 66.

8. A golf club head, comprising:

a body formed of a first material and having a front surface, a sole, a back, a heel, a toe, and a top;

an insert formed of a second material coupled to said body at said top, said insert formed of a material including nylon;

a free-layer damping system; and a constrained-layer damping system; wherein:

said free-layer damping system includes a second insert coupled to said back opposite said front surface; and said constrained-layer damping system includes a third insert coupled to a top surface of said sole and a weight member coupled to a top surface of said third insert.

9. The golf club head of claim 8, further comprising a protrusion extending away from the body at the top, and wherein the insert is coupled to the body at the protrusion.

10. The golf ball of claim 8, wherein the nylon has a tensile strength of 15 kpsi to 20 kpsi at 50 percent relative humidity and 73° F.

11. The golf ball of claim 8, wherein the nylon has a specific gravity of 1.25 to 2 at 50 percent relative humidity and 73° F.

12. The golf club head of claim 8, wherein the club head has a top line formed by portions of the insert and the body.

13. The golf club head of claim 12, wherein all of the front surface comprises the first material.

14. A golf club head, comprising:

a body formed of a first material and having a front surface, a sole, a back, a heel, a toe, and a top; and an insert formed of a second material coupled to said body at said top, said insert formed of a light-weight material having a density less than that of said body;

a free-layer damping system comprising a second insert coupled to the back opposite the front surface; and a constrained-layer damping system comprising a third insert coupled to a top surface of the sole and a weight member coupled to a top surface of the third insert.

15. The golf club head of claim 14, further including a protrusion extending away from said body at said top, and wherein said insert is coupled to said body at said protrusion.

16. The golf club head of claim 15, wherein the club head has a top line formed by portions of said insert and said body.

17. The golf club head of claim 16, wherein all of said front surface is formed of said first material.

18. The golf club head of claim 14, wherein said body has a first density that is greater than said light-weight material density by at least 3 $g/cm^3$.

19. The golf club head of claim 14, wherein the light-weight material has a flexural modulus of 650 kpsi to 750 kpsi at 50 percent relative humidity and 73° F.

20. The golf club head of claim 14, wherein the light-weight material has a tensile strength of 15 kpsi to 20 kpsi at 50 percent relative humidity and 73° F.

21. The golf head of claim 14, wherein the light-weight material has a specific gravity of 1.25 to 2 at 50 percent relative humidity and 73° F.

* * * * *